US005208945A

United States Patent [19]

Dodd

[11] Patent Number: 5,208,945

[45] Date of Patent: May 11, 1993

[54] MECHANISM FOR OPENABLE/CLOSEABLE MEANS

[75] Inventor: Graham S. Dodd, Lymm, United Kingdom

[73] Assignee: Pilkington PLC, Merseyside, England

[21] Appl. No.: 777,917

[22] Filed: Oct. 17, 1991

[30] Foreign Application Priority Data

Oct. 17, 1990 [GB] United Kingdom ..... 9022476

[51] Int. Cl.[5] ..... E05D 11/06

[52] U.S. Cl. ..... 16/358; 16/359

[58] Field of Search ..... 16/358, 359

[56] References Cited

U.S. PATENT DOCUMENTS

| | | | |
|---|---|---|---|
| 2,206,499 | 7/1940 | Dumelin | 16/358 |
| 2,515,071 | 7/1950 | Battersby . | |
| 2,947,025 | 8/1960 | Campbell et al. . | |
| 5,050,270 | 9/1991 | Burgei et al. | 16/358 |

FOREIGN PATENT DOCUMENTS

| | | |
|---|---|---|
| 0098063 | 1/1984 | European Pat. Off. . |
| 345578 | 12/1920 | Fed. Rep. of Germany . |
| 3004029 | 8/1981 | Fed. Rep. of Germany . |
| 2270424 | 12/1975 | France . |
| 166959 | 7/1921 | United Kingdom . |

*Primary Examiner*—John Sipos
*Assistant Examiner*—Carmine Cada
*Attorney, Agent, or Firm*—Freed, Kjeldgaard, Griffin & Inskeep

[57] ABSTRACT

This invention relates to a mechanism or hinge for use in a structural glass assembly. In particular the mechanism is attachable to a glass unit, e.g. a double glazing unit, to enable it to open or close. The mechanism has essentially two parts, a stationary part and a movable part. The stationary part which is attachable to the glass structure incorporates two blade-like plates between which the movable part is slideably located. The stationary part has two arcuate tracks (open and closed) over which a pair of roller bearings are guided during operation of the mechanism whereas the movable part which is attachable to e.g. a double glazed unit, has a single arcuate track over which a single roller bearing is guided during operation of the mechanism. The mechanism has a virtual pivot point on the glazing unit to which the mechanism is attachable. One embodiment of the invention includes a centring arrangement FIG. 5 where a pair of tapered roller bearings are guided on arcuate tapered surfaces of a closed track.

27 Claims, 3 Drawing Sheets

MECHANISM FOR OPENABLE/CLOSEABLE MEANS

BACKGROUND OF THE INVENTION

The present invention relates to a mechanism which serves as a hinge for openable/closeable means mounted in a structure.

The mechanism finds particular utility in structural glass assemblies of the type known as suspended glass assemblies and in general building cladding arrangements. Typically, in structural glass assembly may consist of a rectangular array of glass units (usually of the double glazed type) which are attached to a structural frame by metal fittings.

Some of these assemblies incorporate glass units which are adapted to open and close and to facilitate this, various designs of hinge mechanisms have been proposed. Usually the glass units are quite heavy and as a consequence the hinge mechanism employed must be of a robust design. Additionally it is desirable for the hinge mechanism to be relatively uncomplicated, have a minimum of relatively moveable parts and offer relatively little friction between the relatively moveable parts.

A known hinge mechanism, disclosed in UK specification No 1315200, is arranged for connecting one hollow tubular member at one of its ends to a support member, the members being permitted to move relative to one another.

This hinge mechanism is essentially a three-part assembly and is for use in a folding bed. Two outer hinge members, which are arranged to move independently of each other, are substantially identical and consist of a thick block-like portion having a rectangular cross-section and a thinner portion with a rounded end. A semi-circular projection is formed on a flat side facing inwards. An inner or central hinge member, located between the two outer hinge members, has corresponding semi-circular grooves on each of its sides, the grooves being of such width and depth that the semi-circular projections are a sliding fit in these grooves.

The major faces of the grooves and projections are always in slideable contact with each other during operation of the hinge. Thus, there is a considerable amount of friction created between the relatively moveable parts of the hinge.

A further type of hinge is described in European specification No 0098063. This hinge is for an openable roof panel for a vehicle.

The hinge comprises a spade member, including an arcuate portion, the spade member being secured to the openable roof panel. A socket member, which is an open-ended arcuate channel, is secured to a frame. The arcuate portion of the spade member is slideably located within the arcuate channel one wall of which is mounted on resilient means which when released, causes the width of the channel to be less than the thickness of the arcuate portion of the spade member.

The major surfaces of the arcuate portion of the spade member and the arcuate channel are always in slidable contact with each other during operation of the hinge. Thus, in this hinge mechanism also there is a considerable amount of friction created between the relatively moveable parts.

An aim of this invention is to provide a mechanism which may be used as a hinge and which is compact, simple and robust in construction and operates with relatively little friction between the relatively moveable parts.

SUMMARY OF THE INVENTION

According to this invention there is provided a two-part mechanism serving as a hinge for openable/closeable means mounted in a structure, the mechanism comprising a stationary part and a movable part, wherein the stationary part includes first locating means for accommodating first attachment means for facilitating attachment of the stationary part to the structure, first arcuate track means and first bearing means, and wherein the movable part includes second locating means for accommodating second attachment means for facilitating attachment of the movable part to the openable/closeable means, second arcuate track means and second bearing means, whereby in operation of the mechanism to enable opening/closing of the openable/-closeable means with respect to the structure, the relative movement of the movable part with respect to the stationary part is such that the second bearing means is guided progressively over the first arcuate track means and is arranged to make contact with at least one point on the first arcuate track means only during the relative movement while the second arcuate track means is guided progressively over the first bearing means which is arranged to make contact with at least one point on the second arcuate track means only during the relative movement, the effective pivotable point of the mechanism being defined as a virtual pivot point. The virtual pivot point is preferably located at a point upon the openable/closeable means to which the mechanism is attachable.

The virtual pivot point is preferably arranged to lie at an uppermost outer point of the openable/closeable means adjacent an uppermost part of the mechanism or hinge and it is arranged for the arcuate track means to be directly geometrically relative to the virtual pivot point to define the arcuate track means.

Preferably the stationary part comprises a flat mounting plate member from which extend perpendicularly two parallel spaced-apart substantially triangular-shaped blade-like plates each of which may incorporate a leg portion.

Preferably the movable part comprises a substantially triangular-shaped blade-like plate being slideably located in the space between the spaced-apart blade-like plates of the stationary part.

The first arcuate track means may comprise a pair of adjacent arcuate edge faces, one arcuate edge face of the pair being located on one of the spaced-apart blade-like plates of the stationary part and the other arcuate edge face of the pair being located on the other of the spaced-apart blade-like plates of the stationary part.

The first arcuate track means may comprise an arcuate slot with closed ends located in one of the spaced-apart blade-like plates of the stationary part and an adjacent arcuate slot with closed ends located in the other of the spaced-apart blade-like plates of the stationary part.

The second arcuate track means may comprise a single arcuate edge face located on the substantially triangular-shaped blade-like plate of the movable part.

The second arcuate track means may comprise a single arcuate slot with closed ends located in the substantially triangular-shaped blade-like plate of the movable part.

Preferably the first and second bearing means are roller bearings, the first bearing means comprising a single roller bearing mounted between and at a corner of the blade-like plates on the stationary part. The first bearing means may be mounted between the extremities of each of two leg portions located at one corner of the stationary part.

The second bearing means preferably comprises a pair of roller bearings being mounted opposite each other on opposing faces of the substantially triangular-shaped blade-like at one corner of the movable part.

In operation the movement of the mechanism or hinge towards the closed position may be limited by stop means located on the stationary part at each end of the arcuate edge face opposite the end incorporating the leg portion, the pair of roller bearings abutting the stop means in the closed position of the mechanism of the pair of roller bearings abutting the closed ends of the arcuate slots adjacent the flat mounting plate member.

Movement of the mechanism towards the open position may be limited by the pair of roller bearings abutting each leg portion or the closed ends of the arcuate slots remote from the flat mounting plate member.

The hinge mechanism may include an arrangement for centring the movable part between the two blade-like plates of the stationary part.

The centring arrangement may comprise the single roller bearing means on the movable part being constituted by two separate tapered roller bearings positioned side-by-side and corresponding tapered arcuate surfaces in the arcuate slot.

Preferably the tapered bearings taper outwardly from their inner faces from a smaller diameter to a larger diameter at their outer faces.

The first attachment means preferably comprises a 'T'-bolt and securing nut whereas the second attachment means preferably comprises a countersunk headed bolt, a spacer and a securing nut.

The openable/closeable means may be a double glazing unit, a single glazing unit or a laminated glazing unit.

The invention will be more readily understood from the following description of several exemplary embodiments which should be read in conjunction with the accompanying drawings in which;

DESCRIPTION OF THE PREFERRED EMBODIMENT

Figure 1:
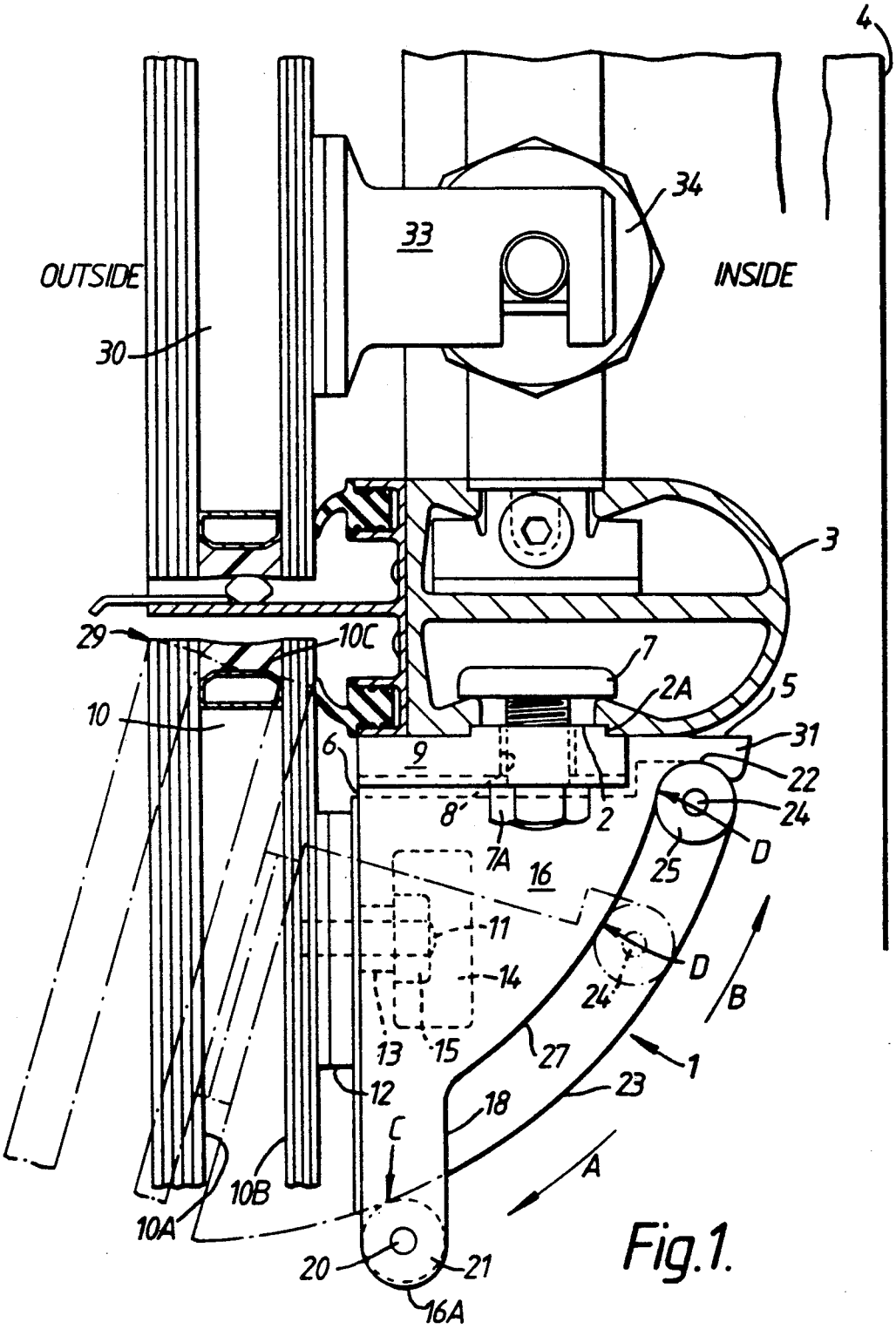
FIG. 1 shows a sectionalised side view of a portion of a glass assembly incorporating the mechanism in accordance with the present invention.

Referring to the drawings, the mechanism or hinge 1 is shown mounted and aligned by means of an alignment rib 2 within a slot 2A on an external crossmember or transom 3 which is supported by a mullion 4. The mechanism essentially comprises two parts 5 and 6, and one of the parts is a stationary part 5, while the other part is a movable part 6. Both these parts are preferably manufactured in metal.

The stationary part 5 is securely attached to the transom 3 by first attachment means in the form of 'T'-bolts, one of which is designated 7 which locates through location means in the form of bores such as 8 in a flat mounting-plate member 9 which is integral with the stationary part 5. The bolt is secured by a standard securing nut 7A.

The movable part 6 is securely attached to an openable/closeable means by second attachment means in the form of a double glazed unit 10 by a countersunk-headed bolt 11 passing through a suitable bore in the inner pane of the double glazed unit 10, through a threaded bore in a spacer 12, and through a slotted aperture 13 in the movable part 6 to extend into a recess 14 where it is secured by a standard securing nut 15. Conveniently the threaded bore in the spacer 12 enables the spacer to be tightened against the rear face of the inner pane of the double glazed unit 10, the countersunk head of the bolt 11 being securely retained within an appropriately shaped recess in the front face of the inner pane of the double glazed unit 10. The double glazed unit 10 comprises two flat sheets of glass 10A and 10B held in spaced relationship by a peripheral spacer 10C in well known manner.

Figure 2:
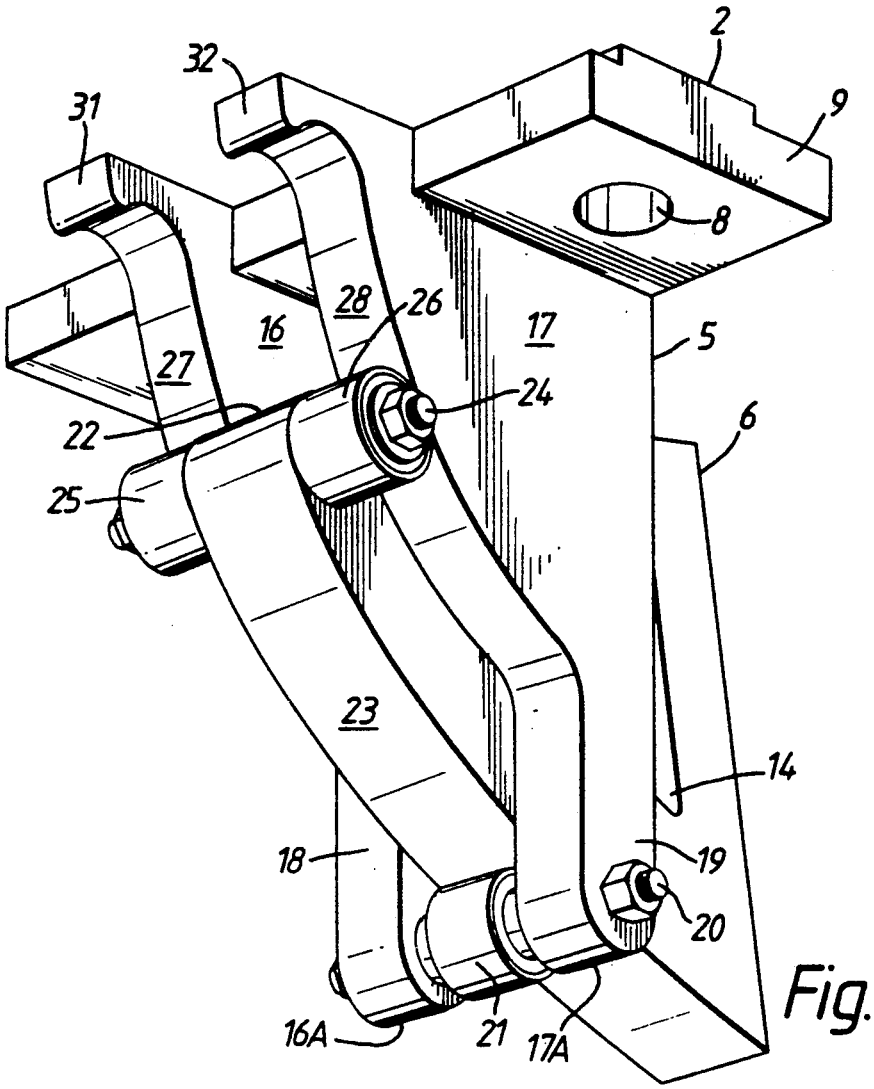
FIG. 2 shows a perspective view of an arrangement of the mechanism in accordance with this invention.

As will be best observed from FIG. 2, the stationary part 5 has two parallel spaced-apart blade-like plates 16 and 17 respectively which are perpendicular to the flat mounting plate member 9. The blade-like plates 16 and 17, which are substantially triangular-shaped each incorporate leg portions 18 and 19 respectively at one corner 16A, 17A thereof. At this corner a single bearing means, in the form of a roller bearing 21, is mounted on a spindle 20 between plates 16 and 17.

The movable part 6 of the mechanism or hinge is also a substantially triangular-shaped blade-like plate which is movably located in the space between the plates 16 and 17. One of the edge faces 23 of the plate 6 is arcuate in shape and at one of the corners 22 of the plate at an end of the arcuate edge face 23, there is mounted, on a spindle 24, a pair of bearings in the form of roller bearings 25 and 26. These roller bearings 25 and 26 are positioned opposite each other one on each side of the plate 6 at the uppermost corner 22 and are so arranged in operation of the mechanism to be guided over adjacent arcuate edge faces 27 and 28 of the plates 16 and 17 respectively which serve as tracks for the roller bearings 25 and 26 respectively to run over. Likewise, in operation of the mechanism, the arcuate edge face 23 or track is guided over the roller bearings 21. Since the bearings are of the rolling type and only progressive contact with one point on the track 23 is made during operation of the mechanism, then friction between the relatively movable parts 5 and 6 on the hinge mechanism is kept to a minimum.

Referring to FIG. 1, the direction of relative movement of the movable part 6 with respect to the stationary part 5 is indicated by the arrows A and B. Direction A is the direction the movable part 6 takes when the unit 10 is opening (a partially open position is illustrated by the chain dotted lines indicating the main position of the unit 10 and the movable part 6). Direction B is the direction taken by the movable part 6 when the unit 10 is being closed. The closed position is shown in full line in FIG. 1, whereas a partially open position is shown in FIG. 2.

It will be seen in FIG. 1 that the structural glass assembly is a vertical assembly and that the double glazed unit 10 is openable outwardly towards the OUTSIDE of the building, the mechanism or hinge 1 being located on the INSIDE of the building. It should be understood that it is arranged that the pivotable point of the mechanism is effectively a virtual pivot point which lies at a point 29, which is at the uppermost outer point of the double glazing unit adjacent the uppermost part of the mechanism or hinge, (in another orientation of the mechanism, this point will always be the outer point nearest the mechanism or hinge mounting-plate member 9). The movement of the mechanism and the openable double glazed unit 10 is featured about this point by arranging for the arcuate surfaces 23, 27 and 28 to be directly geometrically related to this point to define these arcuate surfaces, in relation to the virtual pivot point, i.e. the point is the centre of curvature of the arcs.

The arcuate tracks 27 and 28 over which the roller bearings 25 and 26 respectively are guided is an open track and it may appear that the roller bearings may leave the track during movement of the double glazed unit 10. This is not possible in an arrangement which is in the vertical plane since the gravitational weight of the unit in a downward direction retains the arcuate track 23 firmly against the roller bearing 21 (see arrow C). Likewise, because of an anticlockwise force being exerted on the movable part 6 by the weight of the double glazed unit 10 attempting to close, this force retains roller bearings 25 and 26 firmly against the arcuate tracks 27 and 28 respectively (see arrows D). Thus, in the vertical position of the hinge the arcuate track can be open.

Figure 3:
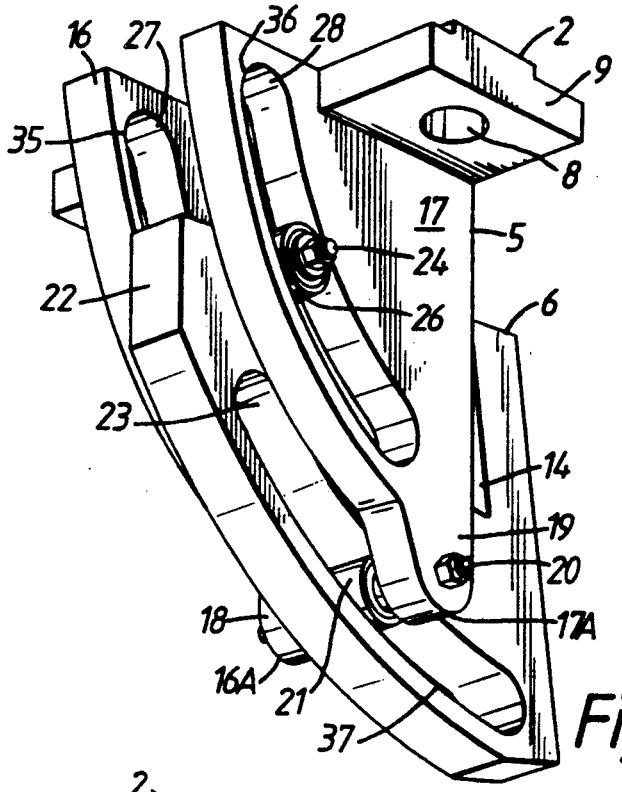
FIG. 3 shows a perspective view of an alternative arrangement of the mechanism according to this invention.
Figure 4:
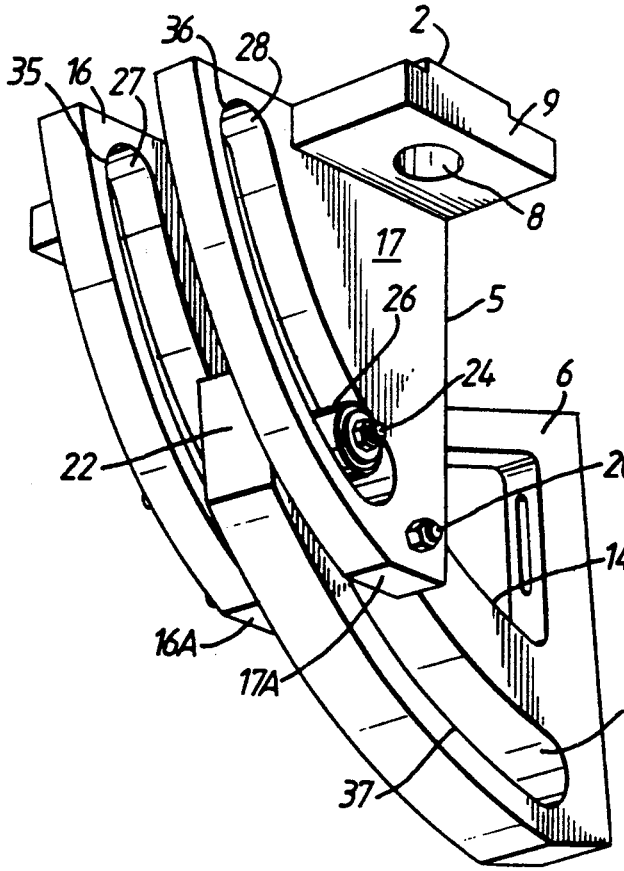
FIG. 4 shows a perspective view of a further alternative arrangement of the mechanism in accordance with this invention; and, FIG. 5 a sectional view of a part of the mechanism illustrating the arrangement of the second bearing means to achieve centring of the blade of the movable part located between the adjacent outer blades of the stationary part.

However, it should be understood that in order to operate the mechanism or hinge in positions other than the vertical, it is necessary to have the rollers run in a closed track i.e. an arcuate slot having closed ends, but otherwise the mechanism or hinge operates in the manner similar to that described herein. Two examples of the mechanism including such arcuate slots are shown in FIG. 3 and FIG. 4. In these two figures like components have been given identical designations as those employed in FIG. 1 and FIG. 2, the closed tracks or arcuate slots being designated 35 and 36 on the stationary part 5 and 37 on the movable part 6.

The movement of the mechanism or hinge 1 shown in FIG. 1 and FIG. 2 is limited towards the closed position by stop means 31 and 32 at the end of each arcuate surface opposite the ends incorporating the leg portion, the pair of roller bearings 25 and 26 abutting stops 31 and 32 respectively as shown in FIG. 1 in the closed position of the mechanism. The movement of the mechanism 1 towards the open position is limited by the pair of roller bearings 25 and 26 abutting the leg portions 18 and 19 respectively.

Naturally in the arrangements shown in FIG. 3 and FIG. 4 the movement of the mechanism towards the closed position is limited by the roller bearings 25 and 26 abutting the closed ends of the arcuate slots 35 and 26 respectively which are adjacent the mounting plate 9. The movement of the mechanism towards the open position is limited by the roller bearings 25 and 26 abutting the closed ends of the arcuate slots 35 and 36 respectively which are remote to the mounting plate 9.

It has been mentioned previously that the arcuate surfaces are geometrically related to virtual pivot point (point 29 in FIG. 1) and it should be understood that arcuate slots 35, 36 and 37 also conform to this geometric relationship.

Bearing this geometric relationship in mind, it should be appreciated that the embodiment shown in FIG. 4 incorporates arcuate slots which are, in the stationary part 5, and the movable part 6, located adjacent each other e.g. positioned on identical radii. Thus the hinge mechanism shown in FIG. 4 is comparatively more compact with respect to the embodiments shown in FIG. 1 and FIG. 2.

Figure 5:
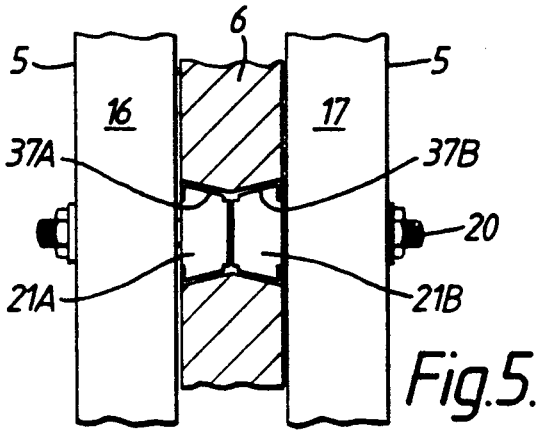

Referring now to FIG. 5, which shows a sectional view of the hinge mechanism illustrating an arrangement for centring the movable part 6 between the two blade-like plates 16 and 17 of the stationary part 5.

In this arrangement it will be appreciated that the parallel-sided roller bearing 21 takes the form of two separate tapered roller bearings 21A and 21B positioned side-by-side on the spindle 20. The bearings taper outwardly, from their inner faces, from a smaller to a larger diameter at their outer faces. Additionally the arcuate surfaces of the arcuate slot 37 both taper outwardly from the centre of the surfaces to the periphery of the slot, as shown at 37A and 37B, to correspond with the bearing contours.

With this arrangement the movable part 6 tends to be maintained centrally between the two outer blade-like plates 16 and 17 of the stationary part 5 and prevents friction between those parts during operation.

A simpler and more convenient way in which to reduce friction between these parts is to insert suitable spacing washers on the spindle 20 between the parts both sides of the roller bearing 21.

In FIG. 1 it will be seen that a fixed double glazing unit 30 is installed above the openable/closeable means and this is securely retained to the transom 3 by suitable metal fittings 33 and 34.

It should be appreciated that while the glazing units are shown as double glazing units such units may comprise single glazing units or may be laminated glazing units.

What is claimed is:

1. A two-part mechanism serving as a hinge for openable/closeable means mounted in a structure, the mechanism comprising in combination:

a stationary part including first locating means for accommodating first attachment means for facilitating attachment of said stationary part to the structure, first arcuate track means and first roller bearing means;

a movable part including second locating means for accommodating second attachment means for facilitating attachment of the movable part to the openable/closeable means, second arcuate track means and second roller bearing means; the first and second roller bearing means respectively making contact with the second and first arcuate track means; wherein in operation of the mechanism to enable opening/closing of the openable/closeable means with respect to the structure, the relative movement of the movable part with respect to the stationary part is such that the second roller bearing means is guided progressively over the first arcuate track means while the second arcuate track means is guided progressively over the first roller bearing means, the effective pivot point of the mechanism being defined as a virtual pivot point which is the center of curvature of the first and second arcuate track means.

2. A two-part mechanism as claimed in claim 1, wherein the virtual pivot point is located at a point upon the openable/closable means to which the mechanism is attachable.

3. A two-part mechanism as claimed in claim 1, wherein the virtual pivot point lies at an uppermost outer point of the openable/closeable means adjacent an uppermost part of the mechanism or hinge.

4. A two-part mechanism as claimed in claim 1, wherein the stationary part comprises a flat mounting-plate member from which extend perpendicularly two parallel spaced-apart blade-like plates.

5. A two-part mechanism as claimed in claim 4, wherein the spaced-apart blade-like plates are substantially triangular shaped.

6. A two-part mechanism as claimed in claim 4, wherein the movable part comprises a blade-like plate which is slideably located in the space between the spaced-apart blade-like plates.

7. A two-part mechanism as claimed in claim 6, wherein the blade-like plate is substantially triangular shaped.

8. A two-part mechanism as claimed in claim 4, wherein the first arcuate track means comprise a pair of adjacent arcuate edge faces, one arcuate edge face of the pair being located on one of the spaced-apart blade-like plates of the stationary part and the other arcuate edge-face of the pair being located on the other of the spaced-apart blade-like plates of the stationary part.

9. A two-part mechanism as claimed in claim 6, wherein the second arcuate track means comprises a single arcuate edge face located on the blade-like plate of the movable part.

10. A two-part mechanism as claimed in claim 1, wherein the first bearing means comprises a single roller bearing mounted between and at one corner of each of the blade-like plates of the stationary part.

11. A two-part mechanism as claimed in claim 10, wherein each said one corner of the blade-like plates incorporates a leg portion between which the single roller bearing is mounted.

12. A two-part mechanism as claimed in claim 11, wherein the second bearing means comprises a pair of roller bearings.

13. A two-part mechanism as claimed in claim 12, wherein the pair of roller bearings are mounted opposite each other on opposing faces of the blade-like plate at one corner of the movable part.

14. A two-part mechanism as claimed in claim 13, wherein movement of the mechanism towards the closed position is limited by stop means located on the stationary part at each end of the arcuate edge face adjacent the flat mounting-plate member, the pair of roller bearings abutting the stop means in the closed position of the mechanism.

15. A two-part mechanism as claimed in claim 12, wherein movement of the mechanism towards the open position is limited by the pair of roller bearings abutting each leg portion.

16. A two-part mechanism as claimed in claim 10, wherein the second bearing means comprises a pair of roller bearings.

17. A two-part mechanism as claimed in claim 16 wherein the pair of roller bearings are mounted opposite each other on opposing faces of the blade-like plate at one corner of the movable part.

18. A two-part mechanism as claimed in claim 17, wherein the first arcuate track means comprises an arcuate slot with closed ends located in one of the spaced-apart blade-like plates of the stationary part and an adjacent arcuate slot with closed ends located in the other of the spaced-apart blade-like plates of the stationary part.

19. A two-part mechanism as claimed in claim 6, wherein the second arcuate track means comprises a single arcuate slot with closed ends located in the blade-like plate of the movable part.

20. A two-part mechanism as claimed in claim 18 wherein movement of the mechanism towards the closed position is limited by the pair of roller bearings abutting the closed ends of the arcuate slots adjacent the flat mounting-plate member.

21. A two-part mechanism as claimed in claim 18, wherein the movement of the mechanism towards the open position is limited by the pair of roller bearings each abutting the closed ends of the arcuate slots remote from the flat mounting-plate member.

22. A two-part mechanism as claimed in claim 19 wherein the mechanism includes an arrangement for centring the movable part between the two blade-like plates of the stationary part.

23. A two-part mechanism as claimed in claim 22, wherein the centring arrangement comprises the first roller bearing means on the stationary part being constituted by two separate tapered bearings positioned side-by-side and corresponding tapered arcuate surfaces in the arcuate slot.

24. A two-part mechanism as claimed in claim 23, wherein the tapered bearings taper outwardly from their inner faces from a smaller diameter to a larger diameter at their outer faces.

25. A two-part mechanism as claimed in claim 1, wherein the first attachment means comprises a 'T' bolt and securing nut and the second attachment means comprises a countersunk headed bolt, a spacer and a securing nut.

26. A two-part mechanism as claimed in claim 1, wherein the openable/closeable means comprises a double glazing unit.

27. Apparatus for pivotably suspending a first glazing unit from a second, vertical glazing unit, a horizontal pivot axis of the first glazing unit being located along its upper edge, comprising:

a movable part for attachment to the first glazing unit, including a first roller bearing and a first arcuate surface having the pivot axis as its center of curvature; and a stationary part for attachment to the second glazing unit, including a second roller bearing and a second arcuate surface having the pivot axis as its center of curvature;

wherein the first bearing is retained in contact with the second arcuate surface and is movable along the second arcuate surface;

wherein the second bearing is retained in contact with the first arcuate surface and is movable along the first arcuate surface; and wherein the weight of the first glazing unit retains the bearings in contact with their respective arcuate surfaces.

* * * * *